US008625823B2

(12) United States Patent
Buck

(10) Patent No.: US 8,625,823 B2
(45) Date of Patent: Jan. 7, 2014

(54) MEMS MICROPHONE OVERTRAVEL STOP STRUCTURE

(75) Inventor: Thomas Buck, Pittsburgh, PA (US)

(73) Assignee: Robert Bosch GmbH, Stuttgart (DE)

( * ) Notice: Subject to any disclaimer, the term of this patent is extended or adjusted under 35 U.S.C. 154(b) by 31 days.

(21) Appl. No.: 13/233,432

(22) Filed: Sep. 15, 2011

(65) Prior Publication Data

US 2013/0016859 A1 Jan. 17, 2013

Related U.S. Application Data

(60) Provisional application No. 61/506,832, filed on Jul. 12, 2011.

(51) Int. Cl.
*H04R 25/00* (2006.01)

(52) U.S. Cl.
USPC ..... 381/174; 381/175; 381/369

(58) Field of Classification Search
USPC ..... 381/113, 116, 173, 174, 175, 191, 369; 29/25.41, 25.42; 438/53; 367/170, 181
See application file for complete search history.

(56) References Cited

U.S. PATENT DOCUMENTS

| | | | | |
|---|---|---|---|---|
| 6,535,460 | B2 | 3/2003 | Loeppert et al. | |
| 7,023,066 | B2 | 4/2006 | Lee et al. | |
| 7,346,178 | B2 * | 3/2008 | Zhe et al. | 381/174 |
| 2007/0154040 | A1 | 7/2007 | Chen | |
| 2008/0123876 | A1 | 5/2008 | Sato et al. | |
| 2009/0208037 | A1 | 8/2009 | Zhe | |
| 2010/0158279 | A1 * | 6/2010 | Conti et al. | 381/174 |
| 2010/0175477 | A1 | 7/2010 | Kasi et al. | |
| 2011/0108933 | A1 | 5/2011 | Nakatani | |

FOREIGN PATENT DOCUMENTS

| | | |
|---|---|---|
| EP | 1748287 | 1/2007 |
| EP | 2214421 | 12/2009 |

OTHER PUBLICATIONS

European Search Report for Application No. 12176039 dated Jul. 18, 2013 (9 pages).

* cited by examiner

*Primary Examiner* — Huyen D Le
(74) *Attorney, Agent, or Firm* — Michael Best & Friedrich LLP

(57) ABSTRACT

A MEMS microphone. The MEMS microphone includes a membrane, a spring, and a first layer having a backplate, and a first OTS structure. The spring has a first end coupled to the membrane, and a second end mounted to a support. The first OTS structure is released from the backplate and coupled to a structure other than the backplate, and is configured to stop movement of the membrane in a first direction after the membrane has moved a predetermined distance.

22 Claims, 7 Drawing Sheets

PRIOR ART

PRIOR ART

MEMS MICROPHONE OVERTRAVEL STOP STRUCTURE

RELATED APPLICATION

The present application claims the benefit of previous filed U.S. Provisional Patent application No. 61/506,832, filed on Jul. 12, 2011, the entire content of which is hereby incorporated by reference.

BACKGROUND

The present invention relates to a type of vertical overtravel stop for a MEMS microphone which does not incorporate the substrate and requires no dedicated insulation layer or special electrical measures to avoid electric shorts during an overtravel event.

Capacitive MEMS microphones are mechanically extremely sensitive devices. They need to operate in a very high dynamic range of 60-80 db ($1/1000$-$1/10000$). To create a membrane which is sensitive enough to detect the lowest pressures (~1 mPa), it must be very compliant to pressure changes. At the same time, the membrane must withstand pressures in the range of several 10s of Pascals without being destroyed. This is typically achieved by clamping the membrane between overtravel stops (OTSs) in both directions. While an OTS towards the backplate (i.e., when the membrane is moving towards the backplate) is relatively easy to realize, the opposite direction (i.e., OTS towards the substrate, when the membrane is moving towards the substrate) either requires another dedicated layer or (typically) uses the substrate as the OTS.

FIG. 1 illustrates a typical capacitive MEMS microphone 100. The microphone 100 includes a backplate 105, a membrane 110, and a substrate 115. The membrane 110 is coupled to the backplate 105 at point 120 (the membrane 110 is insulated from the backplate 105 as they are at different electrical potentials). Sound waves passing through the backplate 105 cause the membrane 110 to vibrate up (in the direction of arrow 125) and down (in the direction of arrow 130). To prevent the membrane 110 from traveling too far toward the backplate 105, shorting the membrane 110 to the backplate 105, overtravel stops (OTSs) 135 are provided at both ends of the membrane 110. Each OTS 135 is sometimes referred to as "an OTS toward the backplate." In addition, the substrate 115 itself provides a second OTS ("an OTS toward the substrate").

During microphone operation, a high bias voltage (e.g., 1 to 40 V) is typically applied between the membrane 110 and the backplate 105. To avoid a short and potential destruction of the electronics, or the MEMS structure itself, series resistors or insulating layers on top of the OTS bumps are required. The use of series resistors requires careful design of the electronics, and the use of insulating layers increases the complexity/cost of the device significantly and may even be impossible due to process constraints. In addition, an insulating layer on top of the bumps is not an ideal solution as long as the membrane and the OTS bump are on different electrical potentials. In this case, electrostatic forces can decrease the pull-in voltage and/or provide sufficient force to keep the membrane 110 stuck to the backplate 105 after contact due to overload. Additional circuitry may be required to detect this and switch off the bias voltage to allow the membrane 110 to release from the backplate 105.

Creating the OTS towards the substrate is especially difficult. Due to processing tolerances during the backside processing, which typically incorporates a high rate trench, accommodations must be made to compensate for possible misalignment. FIG. 2A shows how the trench can vary from the frontside 200 to the backside 205. To accommodate for the typical misalignment 210 between the frontside 200 and the backside 205, the membrane 110 and the substrate 115 have a large, e.g., several microns, overlap. Additionally, the variation of the backside trench leads to a large variation at the deep end of the trench, and adds to the overall tolerances (several tens of microns). The accuracy of the backside trench can be improved at the cost of processing time. Longer processing increases the device's cost.

FIG. 2B shows another solution to this technical problem. A two-step backside trench 215 is used. This results in sufficient accuracy, but doubles the cost of this processing step.

Overlapping of the membrane 110 and the substrate 115 results in a significant and varying parasitic capacitance which directly influences the final sensitivity of the sensor element. Accordingly, it is important to keep the overlap of the membrane 110 and the substrate 115 to a minimum.

SUMMARY

In one embodiment, the invention provides a MEMS microphone. The MEMS microphone includes a membrane, a spring, and a first layer having a backplate, and a first OTS structure. The spring has a first end coupled to the membrane, and a second end mounted to a support. The first OTS structure is released from the backplate and coupled to a structure other than the backplate, and is configured to stop movement of the membrane in a first direction after the membrane has moved a predetermined distance.

In another embodiment the invention provides a method of limiting the movement of a membrane. The method includes coupling the membrane to a spring, coupling the spring to a rigid structure, releasing a first OTS structure from a backplate, and coupling the first OTS structure to a structure other than the backplate. The first OTS structure prevents the membrane from moving more than a first distance in a first direction.

In another embodiment the invention provides a MEMS device. The MEMS device includes a moveable structure, a plurality of springs, and a first layer having a rigid structure, a first OTS structure, and a second OTS structure. Each spring has a first end coupled to the moveable structure, and a second end mounted to a support. The first OTS structure is released from the rigid structure and coupled to the moveable structure. The first OTS structure is configured to stop movement of the moveable structure away from the rigid structure after the moveable structure has moved a predetermined distance.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

The invention allows the elimination of insulation on the OTS bumps. This reduces processing and costs of producing the MEMS microphone. The invention also addresses the OTS towards the substrate issues, removing the need for excess overlap and/or the use of a two-step backside trench. The result is a microphone that is more sensitive (due to reduced or eliminated parasitic capacitance from overlapping of the membrane and substrate) and less expensive (due to reduced processing tolerances and costs).

Figure 1:
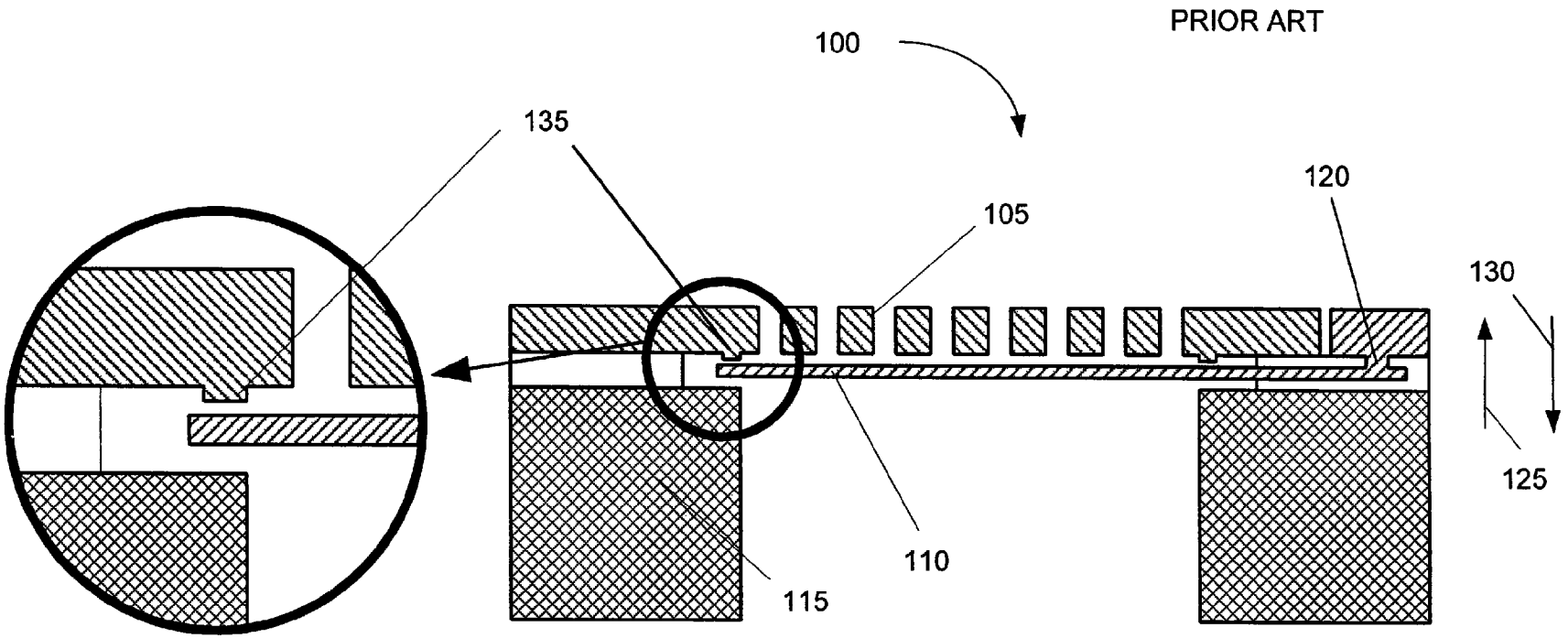
FIG. 1 is a cut-away view of a prior-art MEMS microphone.
Figure 2B:
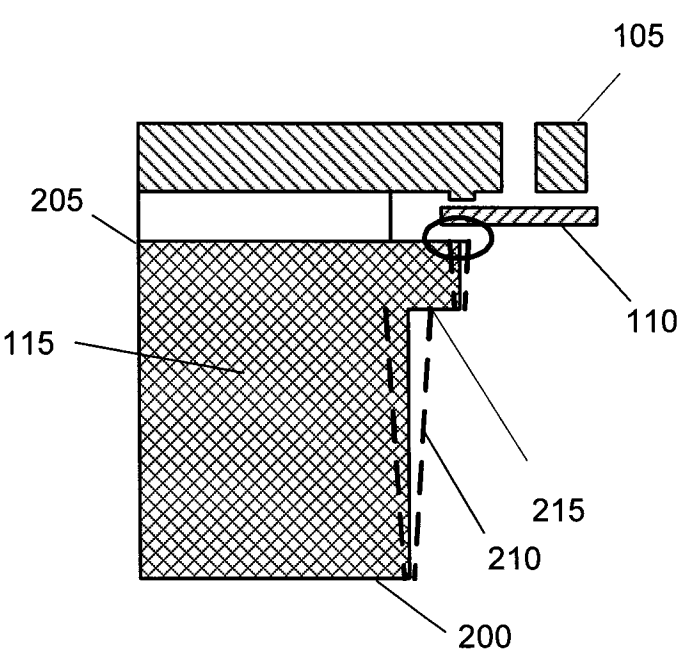
FIGS. 2Aa and 2B are cut-away views of a prior-art MEMS microphone showing variations of a backside trench forming an overtravel stop.
Figure 2A:
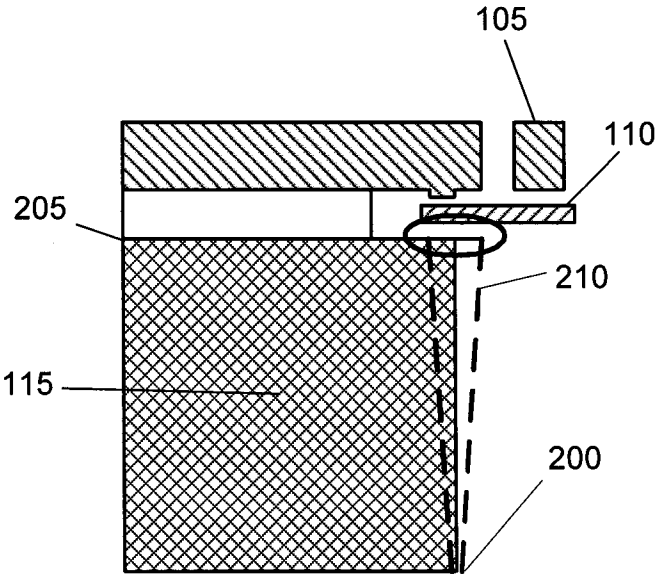
Figure 3B:
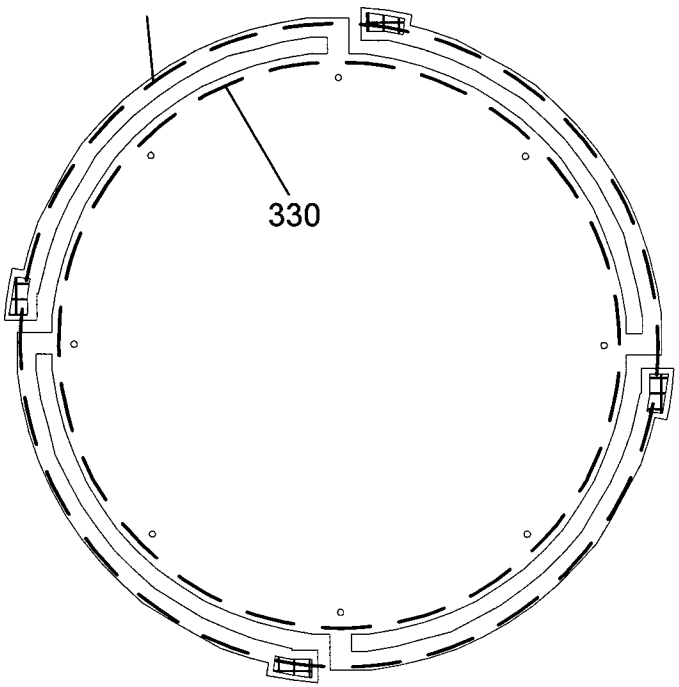
FIGS. 3A and 3B are top views of a prior-art suspended membrane.
Figure 3A:
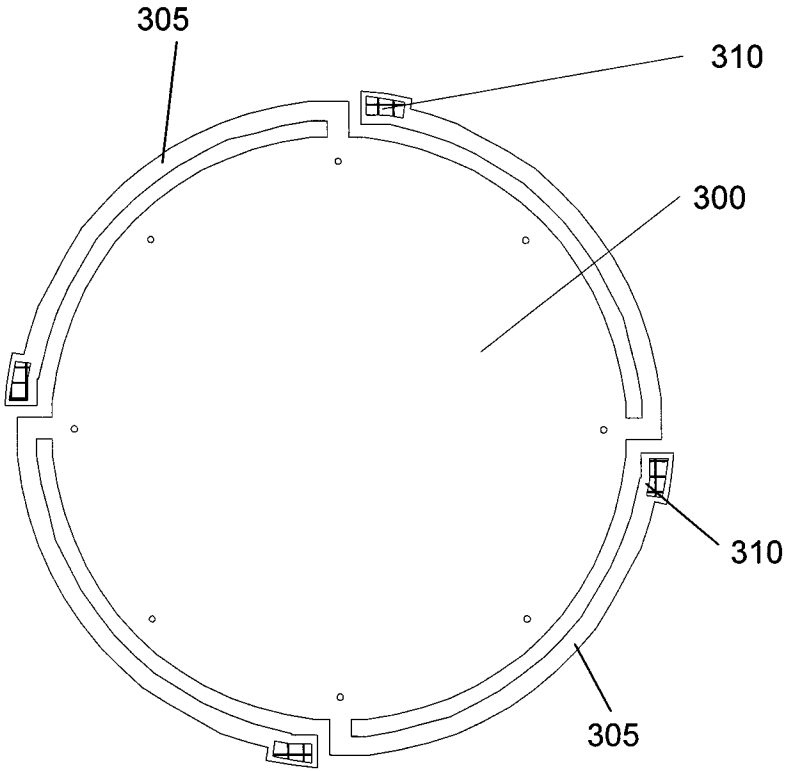

FIG. 3A shows a prior-art MEMS spring suspended membrane 300. The membrane 300 is supported by a plurality of springs 305. The springs 305 are mounted to supports. In some constructions, the supports are part of the backplate layer. In other constructions, the supports are part of the substrate. FIG. 3B shows the overlap of the substrate. Circles 325 and 330 represent variations in a backside trench due to processing tolerances. In order to ensure that the backside trench provides an OTS, the backside trench overlaps at least the springs 305 (circle 325) and, depending on processing, the membrane 300 (circle 330).

Figure 4:
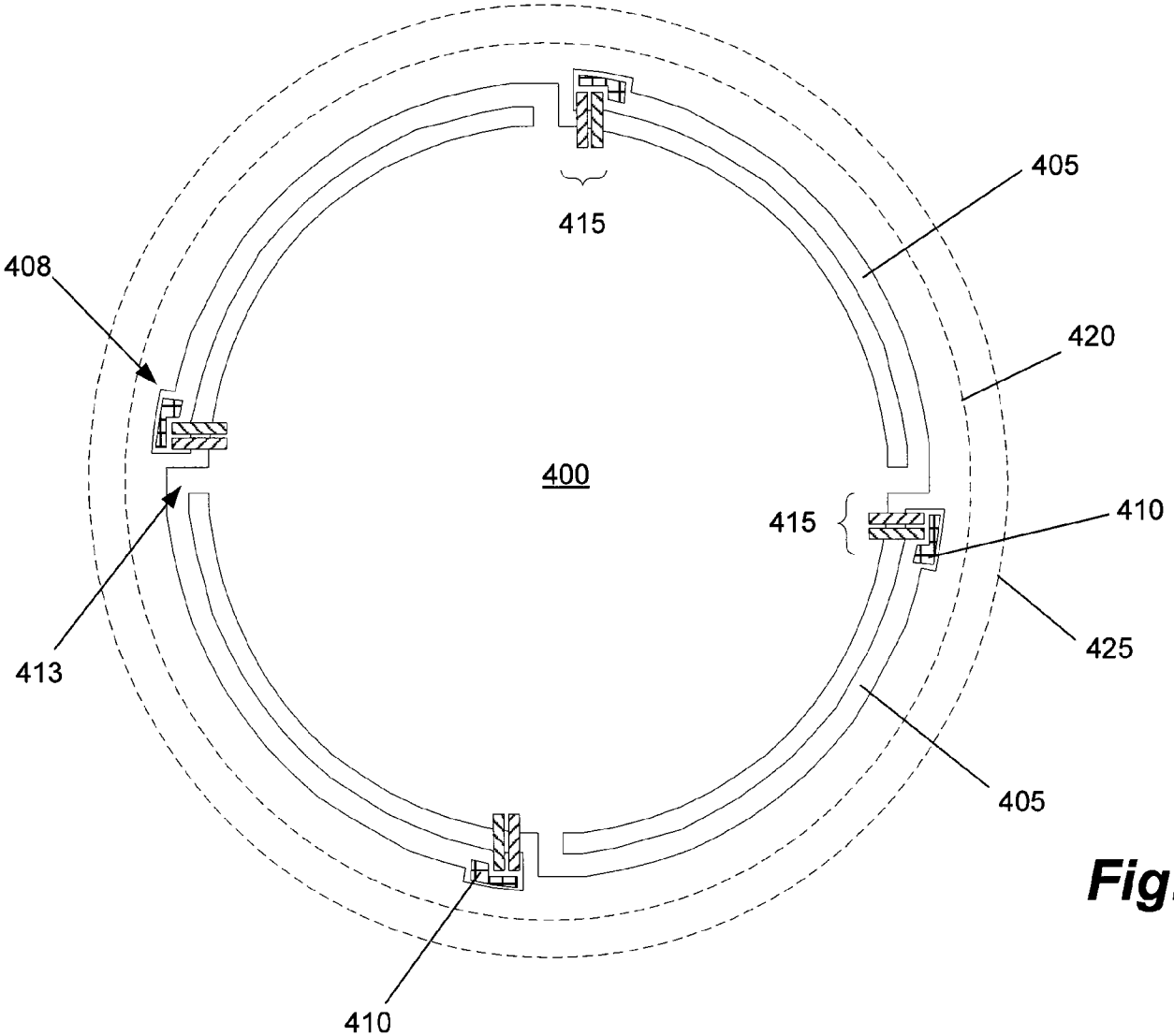
FIG. 4 is a top view of a suspended membrane incorporating an embodiment of the invention.
Figure 5:
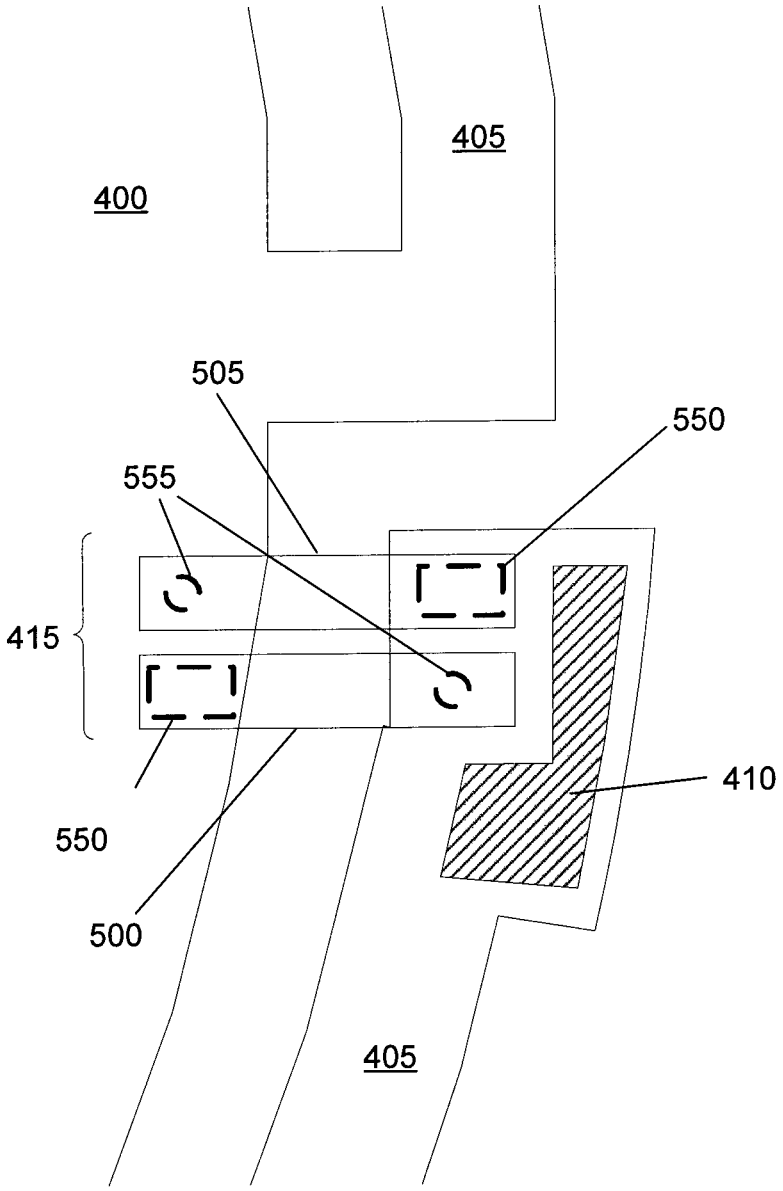
FIG. 5 is a view of an embodiment of OTS structures in relation to a membrane and spring.

FIG. 4 shows a portion of a MEMS microphone. The microphone includes a spring suspended membrane 400 (i.e., a moveable structure) incorporating the invention. Similar to the prior-art membrane 300 shown in FIGS. 3A and 3B, the membrane 400 is supported by a plurality of springs 405. The springs 405 have a first end 408 mounted to a rigid structure via an insulation pad 410. In the construction shown the springs 405 are mounted to a backplate 515 (i.e., a rigid structure). In other constructions, the springs 405 can be mounted to a substrate (i.e., a rigid structure). The springs 405 also have a second end 413 connected to the membrane 400. A plurality of OTS structures 415 (which are part of a backplate layer) provide OTS toward the substrate and toward the backplate. In the construction shown, there are four springs 405 each mounted to the backplate via the insulation pads 410. Circles 420 and 425 represent variations in a backside trench in the substrate due to processing tolerances. Because the OTS structures 415 provide the OTS toward the substrate, the backside trench is outside the springs 405 and membrane 400. Therefore, there is little or no parasitic capacitance between the substrate and the membrane 400, and tolerances can be looser when the backside trench does not function as the OTS.

Figure 6A:
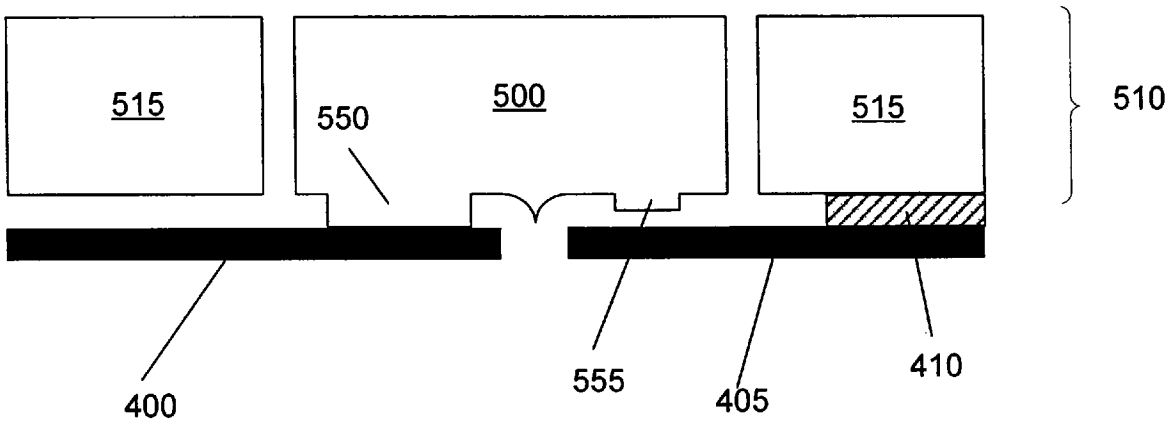
FIGS. 6A and 6B are cutaway side views of the OTS structures, membrane, and spring of FIG. 5.
Figure 6B:
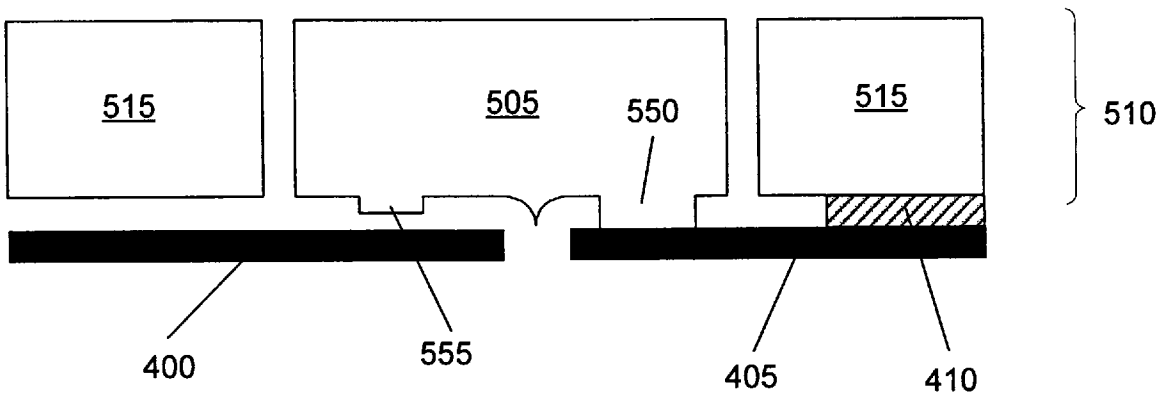

FIGS. 5, 6A, 6B, and 7 are more detailed views of a portion of the MEMS microphone. As shown in the figures, the OTS structures 415 include an OTS toward the substrate structure 500 and an OTS toward the backplate structure 505. Both structures 500 and 505 are part of the backplate layer 510, and are released from the backplate 515 (released refers to a process that disconnects the structures 500 and 505 from the backplate 515). FIG. 6A is a side view showing the OTS toward the substrate structure 500, and FIG. 6B is a side view showing the OTS toward the backplate structure 505. In other constructions, only the OTS toward the substrate structure 500 or the OTS toward the backplate structure 505 are used.

Figure 7:
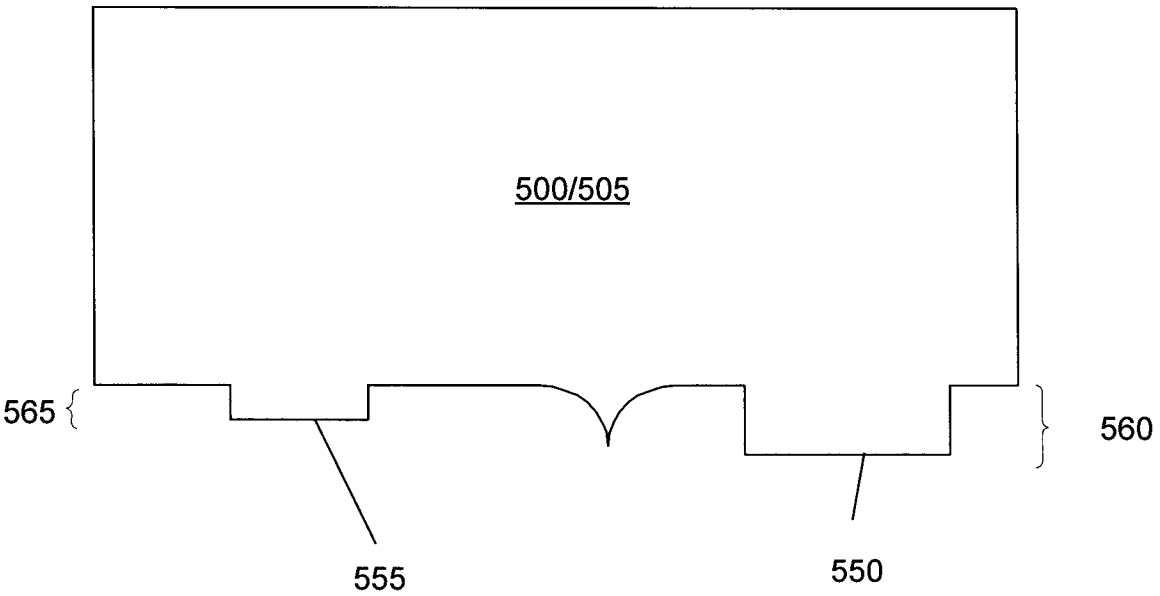
FIG. 7 is an enlarged view of the OTS structures of FIGS. 5, 6A, and 6B.

In the construction shown, the backplate 515 is adhered to the insulation pad 410 which is also adhered to the spring 405. The OTS structures 500 and 505 each include a mounting pad 550 and an OTS bump 555. The mounting pad 550 and the OTS bump 555 are formed during processing of the backplate layer. As shown in FIG. 7, the mounting pad 550 has a first height 560 and the OTS bump 555 has a second height 565. The second height 565 is less than the first height 560, the difference in heights defining the distance the membrane 400 can move (e.g., a predetermined distance). The predetermined distance can be the same or different for the first and second OTS structures 500 and 505. Thus, the predetermined distance can be a first distance for the first OTS structure 500 and a second distance for the second OTS structure 505. In other constructions, an OTS bump is not provided. In such a construction, the OTS structure itself stops further movement of the membrane once the membrane has traveled a predetermined distance.

Referring back to FIGS. 6A and 6B, in the OTS toward the backplate structure 505, the mounting pad 550 is adhered to the spring 405, and the OTS bump 555 is positioned above the membrane 400. As the membrane 400 moves toward the backplate 515, the membrane 400 contacts the OTS bump 555 before the membrane 400 can contact the backplate 515. This prevents the membrane 400 from coming into contact with the backplate 515 and shorting out. Because the OTS toward the backplate structure 505 is released from the backplate 515, and is mounted to the spring 405, which is at the same electrical potential as the membrane 400, the OTS bump 555 does not need to be insulated, and there are no electrical consequences when the membrane 400 comes into contact with the OTS bump 555. In other constructions, the OTS structures are mounted to other structures (e.g., the substrate), rather than the springs or membrane.

In the OTS toward the substrate structure 500, the mounting pad 550 is adhered to the membrane 400, and the OTS bump 555 is positioned above the spring 405. As the membrane 400 moves away from the backplate 515, the membrane 400 pulls the OTS toward the substrate structure 500 down with it. When the membrane 400 has traveled a maximum desired distance, the OTS bump 555 comes into contact with the spring 405 stopping further movement of the membrane 400 away from the backplate 515. This prevents the membrane 400 from moving too far. Again, because the OTS toward the substrate structure 500 is released from the backplate 515, and is mounted to the membrane 400, which is at the same electrical potential as the spring 405, the OTS bump 555 does not need to be insulated, and there are no electrical effects when the OTS bump 555 comes into contact with the spring 405.

The construction shown uses layers that already exist in a MEMS microphone: a membrane layer, a backplate layer, a via layer (for electrical or mechanical) contacts, and a layer forming the OTS bumps. The OTSs in both directions are fully symmetrical, and use the same basic layout. It is not required that both sides of the OTS structure are on an electrically same node. However, putting both sides of the OTS structure on the electrically same node results in:

- No electrostatic forces at the OTS which otherwise could keep the membrane stuck to the backplate (electrostatic stiction). If the overtravel generating force disappears, the membrane will immediately release and go back to operating mode.
- No insulation layers required to have a safe design.

Touching of the OTS will not overload the electronics because neither the capacitance nor resistance or leaks changes during touch.

In addition, the invention applies to MEMS designs which attach a released/insulated part of a stationary layer (e.g., the backplate 515 in the above example) to a movable structure (e.g., the membrane 400 in the above example) to realize any functionally relevant structure. The OTS towards the backplate 515 also acts as a gap defining spacer or post. Thus, when a microphone is operated under conditions which pull the membrane 400, by a high electrostatic force, the posts prevent the membrane 400 from moving too far during regular operation.

Various features and advantages of the invention are set forth in the following claims.

What is claimed is:

1. A MEMS microphone, the MEMS microphone comprising:

a membrane;

a spring having a first end coupled to the membrane, and a second end mounted to a support; and a first layer including a backplate, a first OTS structure released from the backplate, such that the first OTS structure is mechanically and electrically isolated from the backplate, and coupled to a structure other than the backplate, the first OTS structure configured to stop movement of the membrane in a first direction after the membrane has moved a predetermined distance.

2. The MEMS microphone of claim 1, wherein the spring is mounted to the support via an insulator.

3. The MEMS microphone of claim 1, wherein the first OTS structure includes a mounting pad, the first OTS structure mounted via the mounting pad.

4. The MEMS microphone of claim 3, where in the first OTS structure is coupled to the membrane.

5. The MEMS microphone of claim 4, wherein the first OTS structure includes a OTS bump, the OTS bump contacting the spring when the membrane moves away from the backplate and preventing the membrane from moving more than a predetermined distance away from the backplate.

6. The MEMS microphone of claim 5, wherein the mounting pad has a first height, and the OTS bump has a second height, the first height greater than the second height.

7. The MEMS microphone of claim 4, further comprising a second OTS structure coupled to the spring, the second OTS structure configured to prevent the membrane from contacting the backplate.

8. The MEMS microphone of claim 7, wherein the second OTS structure includes a mounting pad and an OTS bump, the second OTS structure mounted to the spring via the mounting pad, the OTS bump contacting the membrane when the membrane moves toward the backplate, preventing the membrane from contacting the backplate, and wherein the mounting pad has a first height, and the OTS bump has a second height, the first height greater than the second height.

9. The MEMS microphone of claim 7, wherein the first OTS structure and the second OTS structure are at the same electrical potential as the membrane.

10. The MEMS microphone of claim 1, wherein the backplate is the support.

11. A method of limiting the movement of a membrane, the method comprising:

coupling the membrane to a spring;

coupling the spring to a rigid structure;

releasing a first OTS structure from a backplate such that the first OTS structure is mechanically and electrically isolated from the backplate; and coupling the first OTS structure to a structure other than the backplate, the first OTS structure configured to prevent the membrane from moving more than a first distance in a first direction.

12. The method of claim 11, wherein the first OTS structure is coupled to the membrane.

13. The method of claim 12, wherein the spring is mounted to the rigid structure via an insulation layer.

14. The method of claim 12, wherein, the first OTS structure contacts the spring before the membrane is damaged when the membrane moves in the first direction, and the membrane contacts the second OTS structure before a backplate when moving in the first direction.

15. The method of claim 11, further comprising coupling a second OTS structure to the spring, the second OTS structure configured to prevent the membrane from moving more than a second distance in a second direction.

16. The method of claim 15, wherein the second direction is opposite the first direction.

17. The method of claim 15, wherein the first direction is toward a backplate, and the first and second OTS structures are released from the backplate.

18. The method of claim 15, further comprising processing a first layer, the processing including forming a plurality of mounting pads, forming a plurality of OTS bumps, and releasing a plurality of first OTS structures and a plurality of second OTS structures, wherein each of the plurality of first OTS structures and the plurality of second OTS structures includes a mounting pad and an OTS bump.

19. The method of claim 18, wherein the first OTS structure is coupled to the membrane via a first mounting pad, and the second OTS structure is coupled to the spring via a second mounting pad.

20. A MEMS device, the MEMS device comprising:

a moveable structure;

a plurality of springs each spring having a first end coupled to the moveable structure, and a second end mounted to a support;

a first layer including a rigid structure, and a first OTS structure released from the rigid structure, such that the first OTS structure is mechanically and electrically isolated from the rigid structure, and coupled to the moveable structure, the first OTS structure configured to stop movement of the moveable structure away from the rigid structure after the moveable structure has moved a predetermined distance.

21. The MEMS device of claim 20, further comprising a second OTS structure released from the rigid structure and coupled to one of the plurality of springs, the second OTS structure configured to prevent the moveable structure from contacting the rigid structure.

22. The MEMS device of claim 21, wherein the first OTS structure includes a first mounting pad and a first OTS bump, the first OTS structure mounted to the one of the plurality of springs via the mounting pad, the OTS bump contacting the moveable structure when the moveable structure moves toward the rigid structure and preventing the moveable structure from contacting the rigid structure, the first mounting pad has a first height, and the first OTS bump has a second height, the first height greater than the second height, the second OTS structure includes a second mounting pad and a second OTS bump, the second OTS structure mounted to the moveable structure via the second mounting pad, the second OTS bump contacting one of the plurality of springs when the moveable structure moves away from the rigid structure and preventing the moveable structure from moving more than a predetermined distance away from the rigid structure, the second mounting pad has a third height, and the second OTS bump has a fourth height, the third height greater than the fourth height.

* * * * *